US005821923A

United States Patent [19]

Van Amesfoort et al.

[11] Patent Number: 5,821,923

[45] Date of Patent: Oct. 13, 1998

[54] PICTURE DISPLAY DEVICE

[75] Inventors: Alfonsus M. Van Amesfoort; Nicolaas Lambert; Kornelis Oostveen; Robert J. Fronen, all of Eindhoven, Netherlands

[73] Assignee: U.S. Philips Corporation, New York, N.Y.

[21] Appl. No.: 606,121

[22] Filed: Feb. 23, 1996

[30] Foreign Application Priority Data

Feb. 23, 1995 [EP] European Pat. Off. ..... 95200444

[51] Int. Cl.[6] ..... G09G 5/00

[52] U.S. Cl. ..... 345/212; 345/70; 345/78; 315/169.3

[58] Field of Search ..... 345/76, 208, 78, 345/209, 212, 70; 307/108; 315/169.3, 169.4

[56] References Cited

U.S. PATENT DOCUMENTS 4,070,663 1/1978 Kanatuni et al. ..... 345/76
4,733,228 3/1988 Flegal ..... 345/76
4,866,349 9/1989 Weber et al. ..... 315/169.4
5,313,136 5/1994 Van Gorkom et al. ..... 313/422
5,559,478 9/1996 Athas et al. ..... 307/108

FOREIGN PATENT DOCUMENTS

0436997A1 7/1991 European Pat. Off. ..... H01J 31/12
942025693 11/1994 European Pat. Off. .

*Primary Examiner*—Steven Saras
*Attorney, Agent, or Firm*—Edward W. Goodman

[57] ABSTRACT

Picture display device with one or more resonant selection pulse drivers for generating selection pulses for selecting rows of pixels. The resonant selection pulse driver has two driver output electrodes to which selection electrode(s) are connected for simultaneously generating a pulse trailing edge at one driver output electrode and generating a pulse leading edge at the other driver output electrode.

6 Claims, 4 Drawing Sheets

PICTURE DISPLAY DEVICE

BACKGROUND OF THE INVENTION

1. Field of the Invention

The invention relates to a picture display device comprising a picture display unit with pixels arranged in rows and selection electrodes for selecting the rows of pixels by means of selection pulses, one or more resonant selection pulse drivers for supplying the selection pulses to the selection electrodes via driver output electrodes, each driver output electrode constituting a capacitive load comprising a selection electrode capacitance for the relevant resonant selection pulse driver, said resonant selection pulse driver comprising switching means and an inductance which constitutes a resonant circuit with said capacitive load when the switching means are closed.

2. Description of the Related Art

Picture display devices of this type may be provided, for example, with an LCD panel, or an EL panel, or a plasma panel. A picture display device of the type described in the opening paragraph, comprising a display unit of the latter type, is known, for example from U.S. Pat. No. 4,866,349.

If a selection pulse is applied to a selection electrode, the capacitance of the selection electrode is charged with an energy which is equal to $\frac{1}{2}CV^2$, in which C represents the selection electrode capacitance and V represents the voltage at which this capacitance is charged. If this charge is effected directly from a DC voltage source, the same quantity of energy will be lost during charging, while the energy stored in the selection electrode capacitance is completely lost during discharge of this capacitance (the trailing edge of the selection pulse). The circuit thus dissipates the total quantity of $CV^2$ of energy during a complete selection pulse. If, as may occur in picture display panels, the selection pulse voltage V is high, and, due to the large length of the selection electrodes, its capacitance C is also high as well as the number (f) of selection pulses to be applied per second to the selection electrodes, then the total dissipation $fCV^2$ is very considerable.

To obviate this drawback, use is made of resonant selection pulse drivers in the above-mentioned known picture display device. The selection electrode is connected to the DC voltage source via first switching means and an inductance. When these first switching means close, there is a half-wave oscillation in the resonant circuit which is constituted by the inductance and the capacitive load constituted by the selection electrode, during which half-wave oscillation the energy $\frac{1}{2}CV^2$ is transferred from the DC voltage source to the selection electrode capacitance via the inductance. The leading edge of the selection pulse then has the shape of half a sine period. The resonant selection pulse driver further comprises second switching means. These means close when the selection pulse must be ended and when there is another half-wave oscillation in said resonant circuit, at which the energy of the selection pulse capacitance flows back to the DC voltage source via the second switching means and the inductance. Thus, there is a recovery of energy towards the DC voltage source. In theory, there would be 100% of energy recovery if all elements were without losses. However, in practice, the recovery of energy is lower (for example, 80%) due to the resistivity of the inductance and particularly the resistance in the switching means, but a very considerable reduction of the dissipation is obtained with respect to the direct generation of selection pulses.

SUMMARY OF THE INVENTION

It is an object of the invention to provide a picture display device having one or more resonant selection pulse drivers with which a further reduction of the dissipated energy is obtained, while in addition the number of required components can be reduced, and to this end the picture display device according to the invention is characterized in that the resonant selection pulse driver is connected between two driver output electrodes, in which the inductance constitutes a resonant circuit together with the capacitive loads of the two driver output electrodes when the switching means are closed.

Unlike the known picture display devices, in which the selection pulse energy is first applied to the selection electrode by means of first switching means and subsequently returned from the selection electrode to the DC voltage source by means of second switching means, the energy is decreased in one electrode and simultaneously increased in the other electrode via the same switching means in the picture display device according to the invention. In other words: the trailing edge of the selection pulse at one electrode and the leading edge of the selection pulse at the other electrode are made simultaneously and with the same components. Consequently, a further reduction of the dissipation is obtained with fewer components per electrode to be driven, because the energy is transported by a factor of 2 less, while a time gain is achieved because the leading edge of a new pulse is already being made during the trailing edge of a selection pulse.

A preferred embodiment of a picture display device according to the invention, using input electrodes which receive selection pulses in a given sequence, is characterized in that each time a resonant selection pulse driver is connected between two driver output electrodes which are juxtaposed in the sequence and in that a resonant selection pulse driver is connected between the last and the first driver output electrode of the sequence. The resonant selection pulse drivers and the electrodes to be driven constitute, as it were, a ring in which the energy of the last electrode is utilized again for building up the selection pulse at the first electrode. Moreover, the number of required resonant selection pulse drivers is equal to the number of electrodes to be driven.

In spite of the above-mentioned measures, the number of required components is still often too high when a large number of selection electrodes must be driven. A further measure of reducing this number of components is to subdivide the selection electrodes into groups of selection electrodes, each group of selection electrodes being connected to a driver output electrode. This measure is of course only usable if it is possible to simultaneously select different selection electrodes, namely, the selection electrodes associated with one and the same group. This is possible, for example, when video information has been made simultaneously available for a plurality of rows of pixels. Another known device in which this is possible is characterized in that it has a multiple selection structure with preselection electrodes for selecting groups of rows of pixels, said preselection electrodes preceding said selection electrodes. A part (for example, all but one) of the group of selection electrodes driven by a driver output electrode may then be inactive for selecting rows of pixels because these rows of pixels are not preselected.

Another measure of preventing unwanted selection by separate selection electrodes when a group of selection electrodes is driven is to incorporate separate switching means per selection electrode for switching off unwanted selection electrodes and switching on desired selection electrodes, respectively.

These and other aspects of the invention will be apparent from and elucidated with reference to the embodiments described hereinafter.

DESCRIPTION OF THE PREFERRED EMBODIMENTS

Figure 1A:
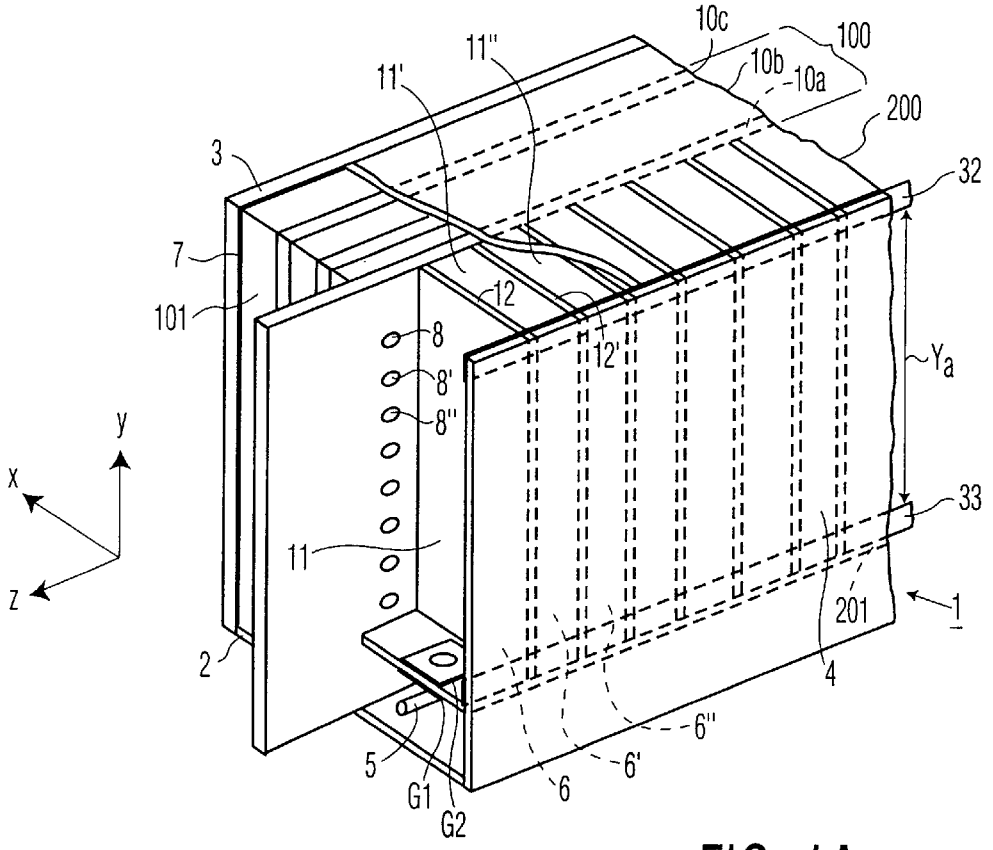
FIG. 1A is a perspective elevational view of a display unit, partly broken way, as can be used in a picture display device according to the invention.
Figure 1B:
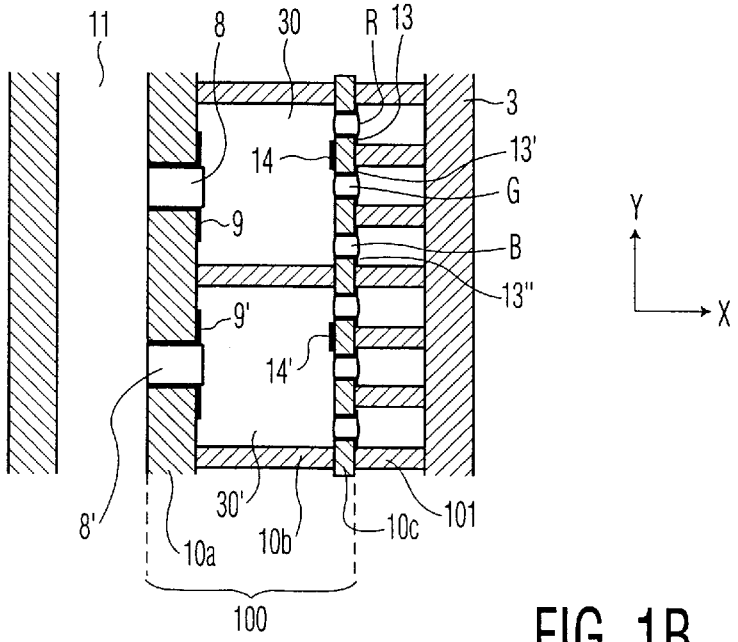
Fig. 1B is a cross-section through the display unit of Fig. 1A.

FIGS. 1A and 1B show a flat-panel display unit 1 which can be used in a picture display device according to the invention. The display unit 1 comprises a display panel 3 built up of a transparent face plate and a luminescent screen 7 and, located opposite thereto, a rear wall 4. The luminescent screen 7, having a repetitive pattern (line or dots) of, for example, triplets of red (R), green (G) and blue (B) luminescing pixels, is provided on the inner surface of the display panel 3. To be able to apply the required high voltage, the luminescent screen 7 is either provided on a transparent, electrically conducting coating (for example, indium tin oxide), or with an electrically conducting coating (for example, A1 backing). In a preferred embodiment, the (dot-shaped) phosphor elements of a triplet are at the vertices of a substantially isosceles or equilateral triangle.

An electron source arrangement 5, for example, a line cathode which by means of drive electrodes, provides a large number (for example, several hundred) of electron emitters, or a similar number of separate emitters, is arranged proximate to a bottom plate 2 which interconnects display panel 3 and rear wall 4. Each of these emitters is to provide a relative small current so that many types of cathodes (cold or thermionic cathodes) are suitable as emitters. The electron source arrangement 5 is arranged opposite entrance apertures of a row of electron propagation ducts extending substantially parallel to the screen, which ducts are constituted by compartments 6, 6', 6", . . . etc . , in this case one compartment for each electron source. These compartments have cavities 11, 11', 11", . . . defined by the rear wall 4 and partitions 12, 12', 12" . . . At least one wall (preferably the rear wall) of each compartment is made of a material having a suitable high electrical resistance in the longitudinal direction of the compartments (for example, ceramic material, glass, synthetic material—coated or uncoated—) and a secondary emission coefficient $\delta>1$ over a given range of primary electron energies. It is alternatively possible to build up (for example, the rear wall) from insulated "isles" (in the longitudinal direction of the compartments) so as to obtain the desired high electrical resistance in the direction of propagation.

The electrical resistance of the wall material in the direction of propagation has such a value that a minimum possible total amount of current (preferably less than, for example, 10 mA) will flow in the walls in the case of a field strength in the axial direction in the compartments of the order of one hundred to several hundred volts per cm required for the electron propagation. In operation, a voltage generating the field strength required for propagation is present between an upper rim 200 and a lower rim 201 of the rear wall 4. The display unit uses the insight disclosed in European Patent Applications EP-A 0 400 750, corresponding to U.S. Pat. No. 5,313,136, and EP-A 0 436 997 that vacuum electron propagation by means of secondary emission (hopping) within compartments having walls of electrically insulating material, is possible if an electric field of sufficient power is applied in the longitudinal direction of the compartment. The contents of European Patent Applications EP-A 0 400 750 and EP-A 0 436 997 are herein incorporated by reference.

By applying a voltage of several tens to several hundreds of volts (value of the voltage dependent on the circumstances) between the row of electron sources 5 and at grids G1, G2 provided at inputs of the compartments 6, 6', 6", . . . , electrons are introduced from the electron sources into the compartments. These electrons are accelerated by said field strength, whereafter they impinge upon the walls in the compartments and generate secondary electrons. The electrons may be extracted, for example, row by row, from the compartments via apertures 8, 8', . . . in a selection plate 10*a* energized by means of electrodes 9, 9', . . . (see Fig. 1B) and accelerated towards the luminescent screen 7 by means of an acceleration voltage applied, in operation, between the selection plate and the luminescent screen.

FIGS. 1A and 1B further show the principle of stepped (multiple) selection. Stepped selected is herein understood to mean that the selection from the compartments 6, 6', 6", . . . to the luminescent screen 7 is realized in at least two steps. A first (coarse) step is carried out to select, for example, the pixels (triplets) (preselection) and a second (fine) step is carried out to select, for example the separate pixels (color selection). An active color selection structure 100, comprising the (active) preselection plate 10*a*, a spacer plate lob and an (active) color selection plate 10*c* is arranged in the space between the compartments and the luminescent screen 7, which is provided on the inner wall of the display panel 3. Structure 100 is separated from the luminescent screen 7 by a screen spacer structure 101, for example an apertured electrically insulating plate.

Fig. 1B is a diagrammatic cross-section of a part of the display device of FIG. 1A in greater detail, particularly, the active selection structure 100 which comprises the preselection plate 10*a* with the extraction apertures 8, 8', 8", . . . and the color selection plate 10*a* with apertures for the various colors R, G and B. The apertures of the color selection plate 10*c* are generally positioned in a triangle, but in the cross-section of FIG. 1B, all three of them have been shown for the sake of clarity. In this case, three color selection apertures are associated with each extraction aperture 8, 8', etc. Other numbers are alternatively possible, for example, 6 color selection apertures per preselection aperture, etc. The spacer plate 10*b* is arranged between the preselection plate 10*a* and the color selection plate 10*c*. This spacer plate comprises communication ducts 30, 30', 30", . . . having a cross-section chosen to fit the shape of the phosphor pixels (for example, circular or triangular triplets).

To be able to extract the electrons via the apertures 8, 8', 8", . . . from the propagation ducts 6, 6', 6", the pierced metal preselection electrodes 9, 9', 9", . . . are provided on the screen-sided surface of the plate 10*a*.

The walls of the apertures 8, 8', . . . are preferably metallized partly or entirely, but there is preferably little or no electrode metal on the surface of the plate 10*a* at the side where the electrons land. This is to ensure that substantially no electrons are left on a selection electrodes during addressing (i.e., the electrode should draw a minimum possible current).

Another solution to the problem of drawing current is to ensure that electrode metal is present on the selection surface where the electrons land, but this metal is given such a large secondary emission coefficient that the preselection electrodes do not draw any net current.

The screen-sided surface of the color selection plate 10*c* is provided with (color) selection electrodes 13, 13', . . . , similarly as the plate 10*a*, so as to realize color selection. Here again the apertures are preferably metallized partly or entirely. As will be described in greater detail, it is possible to electrically through-connect the color selection electrodes. In fact, a preselection per pixel has already taken place and the electrons cannot impinge upon a pixel associated with a different preselection electrode. This means that a minimum number of only three separately formed external connections is required for the color selection electrodes.

The drive is effected, for example, as follows, but other schemes are alternatively possible. The preselection electrodes 9, 9', 9", . . . are brought to a potential which increases substantially linearly with the distance to the electron source arrangement 5, for example, by means of a suitable resistance ladder. One or more picture lines are sequentially selected by applying a positive voltage pulse of, for example 250, volts to the desired preselection electrodes used for selecting these picture lines. During the selection period of a picture line (for example, 30 $\mu$sec) all pixels of said picture line are driven because all propagation ducts (compartments) 6, 6', 6" . . . simultaneously convey current. The different pixels are sequentially addressed by applying shorter pulses (of, for example, 10 $\mu$sec) at an amplitude of, for example 200 V to the color selection electrodes 13, 13', 13". All corresponding pixels of a picture line are thus simultaneously driven and the different pixels of the picture line are sequentially driven. The preselection electrodes preferably have such an electrical resistance, or are connected to external resistors in such a way, that they safeguard the electronics (controlling the drive) against flashover of the luminescent screen.

Figure 2:
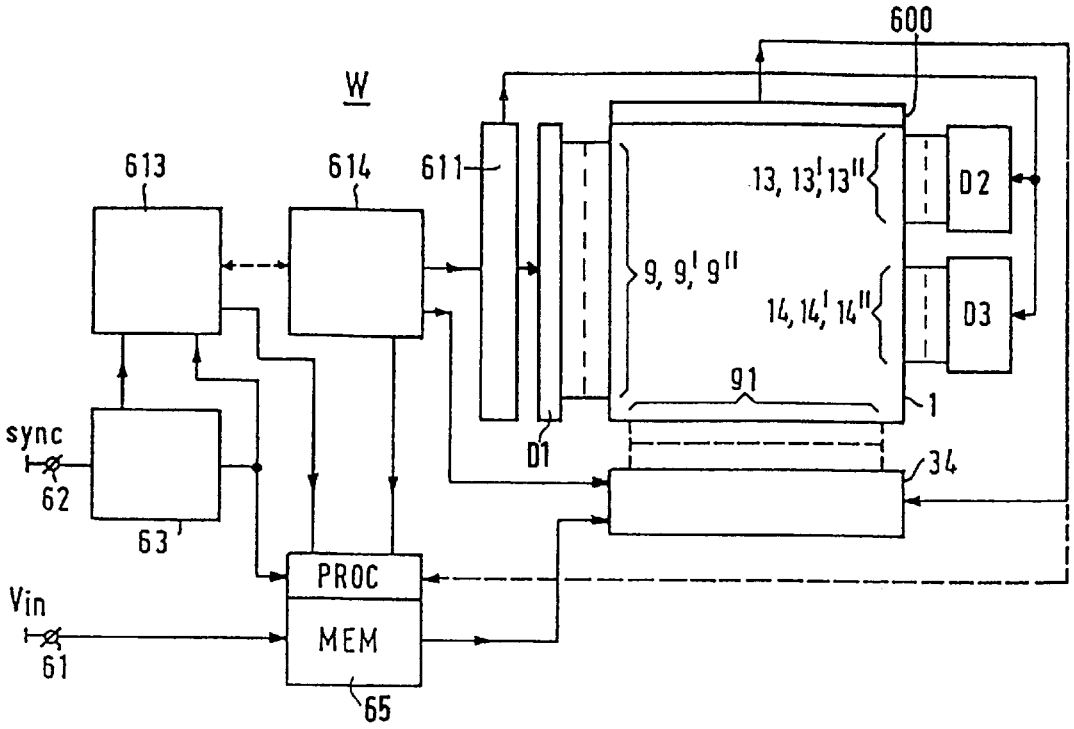
FIG. 2 is a block diagram of an embodiment of a picture display device in which the invention can be used.

FIG. 2 is a block diagram of an embodiment of a picture display device comprising the display unit described hereinbefore. The picture display device receives an input video signal Vin at an input 61. The input video signal Vin is applied to a video signal processing circuit 65. The picture display device receives a synchronizing signal sync at an input 62. The input 62 is connected to a synchronizing processing circuit 63. This synchronizing processing circuit supplies synchronizing signals to a clock generator 613 and determines the television standard of the incoming video signal. The incoming video signal may comprise, for example Y, U, V signals (or R, G, B signals). If the incoming video signal comprises Y, U, V signals, a conversion to R, G, B signals will have to be realized in the video signal processing circuit 65 so as to eventually drive the different phosphors (red, green, and blue) on the display panel 3. The Y, U, V signals may be converted to R, G, B signals by means of a matrix circuit. It is possible to carry out this conversion before the video signal is written into the memory MEM, or when the video signal is read from the memory MEM. The video signal is stored, for example, line by line in the video signal processing circuit 65 under the control of a write clock, for example generated by the clock generator 613. The video signal is supplied line by line, for example, per color line, from an output of the video signal processing circuit under the control of a read clock generated by a clock generator 614 and applied to the video drive circuit 34. In this video drive circuit, the video information of a color line is written under the control of the clock generator 614 and subsequently applied in parallel to the G1 (or G2) electrodes which are present at the inputs of the compartments 6, 6', 6" . . . (see FIG. 1) of the display unit 1, whereafter the video information is displayed on the display panel 3. The lines are selected by means of a selection controller 611. This controller is controlled by a clock signal from the clock generator 614. After each clock pulse, a preselection driver D1 applies new drive voltages to the preselection electrodes 9, 9', 9", . . . (see also FIG. 1) under the control of the selection controller 611. If the picture display device employs a stepped selection, the selection controller 611 also controls a driver D2 for the color selection. This color selection driver D2 is then coupled to the color selection electrodes 13, 13', 13" . . . Moreover, if the picture display device comprises dummy electrodes 14, 14', 14" . . . (to enhance the contrast), the selection controller 611 will also control a dummy electrode driver D3. This dummy electrode driver controls the dummy electrodes 14, 14', 14" . . . . . The selection controller retrieves the information about the drive voltages, for example, from a look-up table or from an EPROM. The display unit 1 has, for example, a construction as described with reference to FIGS. 1A and 1B.

With reference to the incoming video signal, the synchronizing processing circuit 63 determines the line frequency, the field frequency and, for example, also the TV standard and the aspect ratio if the picture display device is suitable for displaying video signals of different TV standards and/or different aspect ratios.

The preselection electrodes 9, 9', 9",. . . . must be controlled by the preselection driver D1 with suitable voltages. These voltages can be subdivided into a bias voltage and a selection pulse. The bias voltage is used for propagation of the electrons in the propagation ducts along the non-selected preselection electrodes. Consecutive preselection electrodes may have a bias voltage which increases with the position across the length of the propagation ducts. The preselection pulse is a pulse of, for example 300 volt pulse height which is superimposed on the bias voltage for the selection electrode whose turn it is to extract electrons from the propagation ducts. Examples of selection drivers realizing these functions are described in prior European Patent Applications 94201470.5 (PHN 14.758) and 94201477.0, corresponding to U.S. patent application Ser. No. 08/712,952, filed Sep. 12, 1996 (PHN 14.787) in the name of the Applicant.

Figure 3:
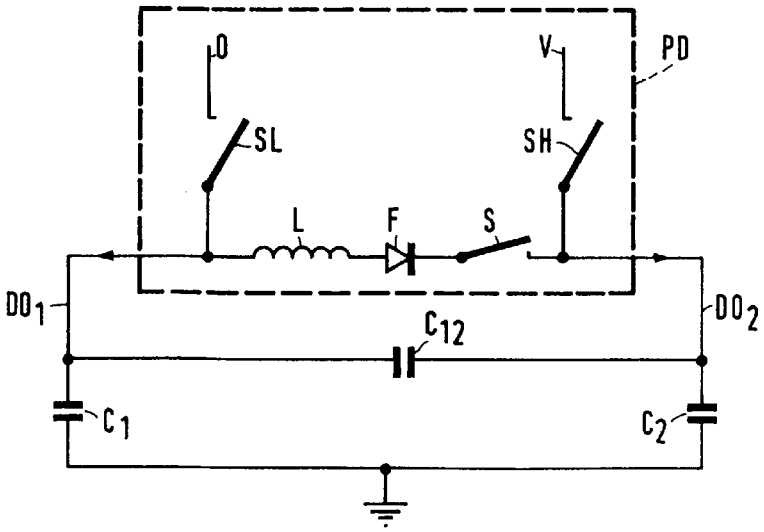
FIG. 3 shows an embodiment of a resonant selection pulse driver for use n a picture display device according to the invention.

The circuit diagram of FIG. 3 shows a resonant selection pulse driver with an inductance L in series with a diode F and a switch S. These three elements may, of course, be interchanged. The series circuit of L, F and S is connected to a first driver output electrode $DO_1$ and to a second driver output electrode $DO_2$. Both driver output electrodes essentially have equal capacitances with respect to ground, denoted by capacitances $C_1$ and $C_2$, respectively. A capacitance $C_{12}$ represents the interelectrode capacitance between the two driver output electrodes.

As a starting position, it is assumed that a voltage pulse having an amplitude V is present at the driver output electrode DO,, no voltage pulse (voltage 0 representing a reference voltage which may deviate from the ground potential of the entire picture display device) is present at the driver output electrode $DO_2$, and that the switch S is open. $C_1$ and $C_{12}$ are therefore charged to the voltage V, and $C_2$ is not charged. As soon as the switch S is closed, a current starts flowing through the series circuit of L, F and S, which current discharges $C_1$, charges $C_2$, and changes the charge of $C_{12}$. The current, having a sine variation due to the now closed resonant circuit L, $C_1$, $C_2$, $C_{12}$, first increases until both voltages at $DO_1$ and $DO_2$ are equal (=½ V) and subsequently decreases until this current is zero again. The resonant circuit has then performed half a sine oscillation. If the circuit were entirely free from losses, the voltage at $DO_1$ would have completely decreased at that instant and the voltage at $DO_2$ would have increased to the voltage V originally present at $DO_1$. The recharge of energy is then terminated. At this instant, the diode F prevents a reversal of the current through the inductance. Instead of using diode F, the switch S may also be used by opening it at the right instant, but this is more complicated.

Since the circuit is subject to losses due to the resistivity of the inductance L, but particularly due to the conducting resistance in the diode F and in the switch S, the voltage at $DO_2$ will not be built up to the original value V at the instant when the current through the inductance has become zero again, while there is still a residual voltage at $DO_1$. To compensate this, the resonant selection pulse driver comprises two extra switches SH and SL. Switch SH connects the driver output electrode $DO_2$ to a supply voltage V and the switch SL connects the driver output electrode $DO_1$ to the 0 voltage. The two switches are open during the transport of energy from $DO_1$ to $DO_2$ but are temporarily closed as soon as this energy transport has terminated, at which SL brings the voltage of $DO_1$ to zero and SH brings the voltage of $DO_2$ to V. Actually, the lost energy is supplemented again by means of SH and SL. If the circuit is incorporated in a periodically operating unit, one of the two switches SH and SL may be replaced by a sufficiently large inductance which connects $DO_1$ and $DO_2$ to a direct voltage which is equal to the mean value of the voltage at $DO_1$ and $DO_2$, respectively. The inductance L may be implemented in two parts, with the switching means F and S being placed between the two parts. This provides a better protection of the switching means F and S from voltage flashover at the driver output electrodes.

Figure 4A:
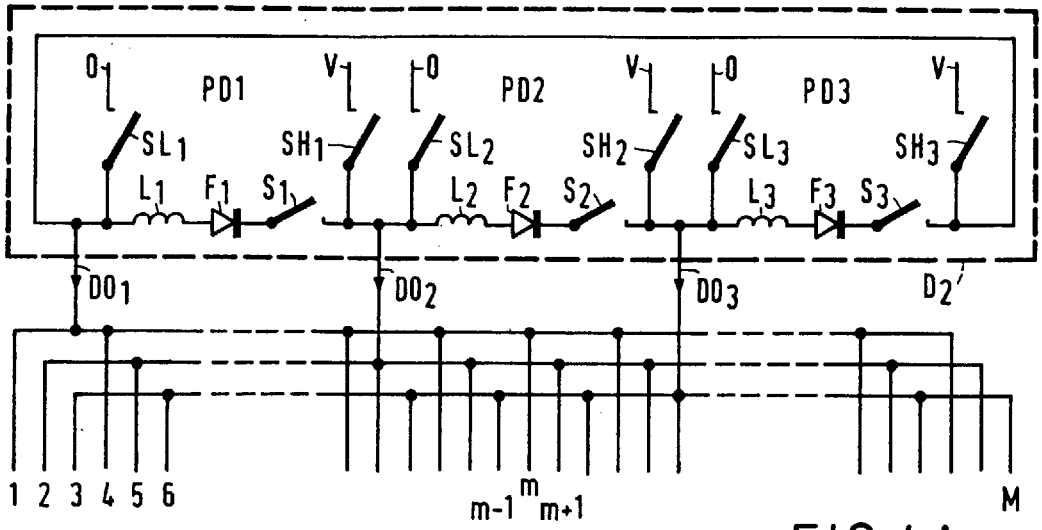
FIG. 4A shows a first embodiment of a picture display device according to the invention.
Figure 4B:
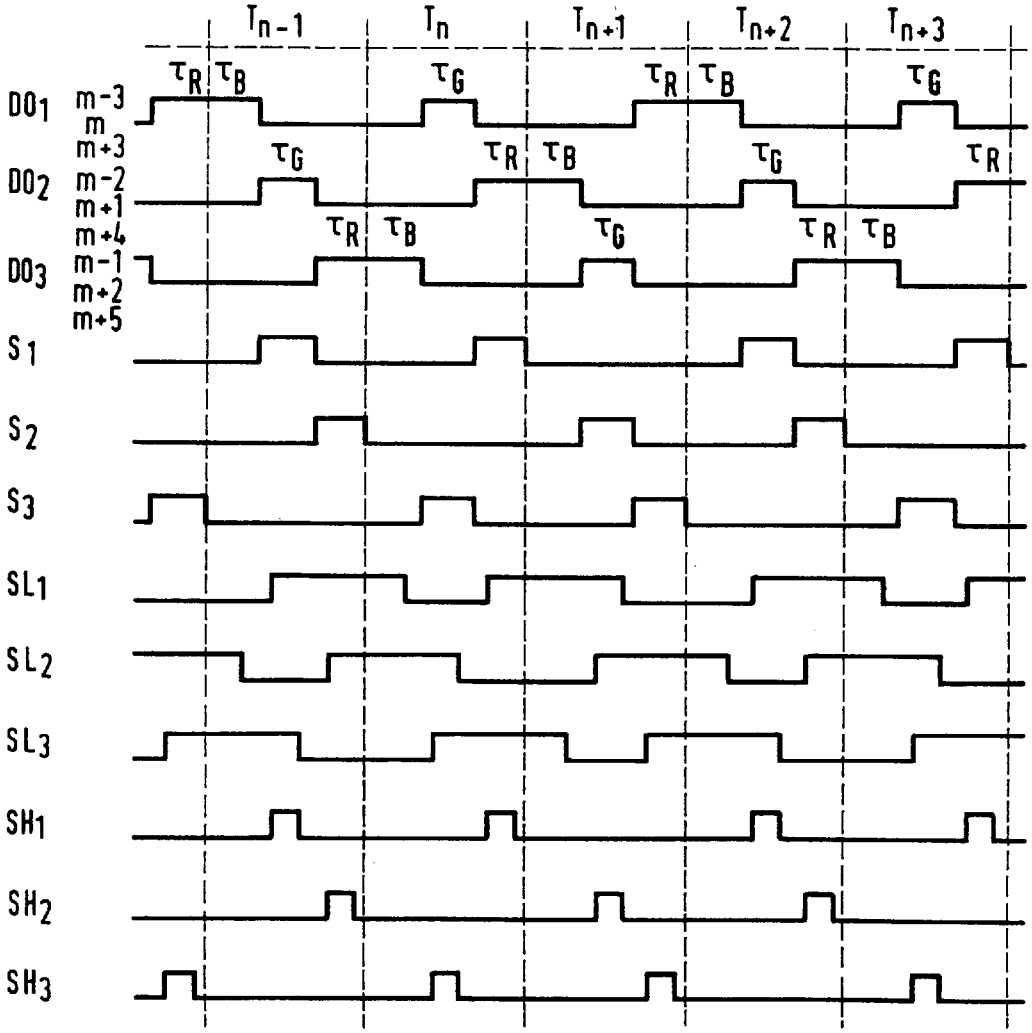
FIG. 4B shows time diagrams to elucidate the operation of the embodiment of FIG. 4A.

FIG. 4 shows the color selection electrodes 13 with ordinal numbers 1 . . . m . . . M. For example, the color selection electrodes with ordinal numbers 1, 4, 7, 10 . . . may be used for selecting the red pixels, those with ordinal numbers 2, 5, 8, 11 . . . may be used for selecting the green pixels and those with ordinal numbers 3, 6, 9, 12 . . . may be used for selecting the blue pixels. If one triplet is selected per preselection electrode, three times as many color selection electrodes as preselection electrodes are required. Prior Patent Applications in the name of the Applicant. (see, for example European Patent Application 94202569.3, corresponding to U.S. patent application Ser. No. 08/524,980, filed Sep. 7, 1995 (PHN 14.980), particularly FIG. 4 and the associated description) state that this number can be reduced by a factor of 3 so that the number of color selection electrodes (M) will be equal to the number of preselection electrodes. Three color selection pulses are then applied to each color selection electrode, one for the selection of a red pixel during a first preselection period, one for selecting a green pixel during a second preselection period, and one for selecting a blue pixel during a third preselection period. The number of color selection pulses to be generated is not changed thereby. The number of required color selection electrodes is reduced and, since they are now further spaced apart, their capacitances are also reduced, and consequently, the energy required for color selection decreases. This measure is used in the embodiment of FIGS. 4A and 4B.

Another measure used in this embodiment is that the color selection electrodes are subdivided into three groups of M/3 color selection electrodes each, the electrodes of each group being interconnected and connected to a driver output electrode $DO_1$, $DO_2$ and $DO_3$, respectively. Consequently, only three driver output electrodes and three resonant selection pulse drivers are required. The interconnection of color-selection electrodes is possible because, due to the preselection, only three juxtaposed color selection electrodes have been preselected simultaneously. For example, when the first preselection is active, the color selection electrodes with m=1, 2 and 3 are preselected, when the second preselection electrode is active, the color selection electrodes with m=2, 3 and 4 are preselected, and so forth. The selection pulses intended for the color selection electrode m =1 can thus also be applied to other color selection electrodes 4, 7, 10 etc. which are not preselected at that instant.

FIG. 4 also shows the internal structure of the color selection driver D2. It comprises three resonant selection pulse drivers $PD_1$, $PD_2$ and $PD_3$ of the type as described with reference to FIG. 3, in which $PD_1$ comprises the elements $L_1$, $F_1$, $S_1$, $SL_1$, and $SH_1$, $PD_2$ comprises the elements $L_2$, $F_2$, $S_2$, $SL_2$ and $SH_2$, and $PD_3$ comprises the elements $L_3$, $F_3$, $S_3$, $SL_3$ and $SH_3$. $PD_1$ is connected between the driver output electrodes $DO_1$, and $DO_2$, $PD_2$ is connected between the driver output electrodes $DO_2$ and $DO_3$ and $PD_3$ is connected between the driver output electrodes $DO_3$ and $DO_1$. The resonant pulse driver $PD_1$ discharges the capacitance of the driver output electrode $DO_1$ and simultaneously charges the capacitance of the driver output electrode $DO_2$, subsequently the resonant pulse driver $PD_2$ discharges the capacitance of the driver output electrode $DO_2$ and simultaneously charges the capacitance of the driver output electrode $DO_3$, and finally $PD_3$ discharges the capacitance of the driver output electrode $DO_3$ and simultaneously charges the capacitance of the driver output electrode $DO_1$. The energy thus circulates so that a minimal quantity of energy is lost.

The switches S, SL and SH preferably consist of "fast recovery IGBTs" which are driven from a logic unit (not shown) by means of pulse series shown in FIG. 4B. In this Figure, the references $T_{n-1}$, $T_n$, $T_{n+1}$, . . . denote a plurality of consecutive preselection periods. The time diagrams denoted by $DO_1$, $DO_2$ and $DO_3$ show the color selection pulses which are generated by the resonant selection pulse drivers $PD_1$, $PD_2$ and $PD_3$ and are supplied via the identically denoted driver output electrodes. $\tau_R$,$\tau_B$ and $\tau_G$ denote the color selection time fractions during which the red, blue and green pixels, respectively, are selected. As already stated above, the pulse series at a given color selection electrode comprises both red and green and blue color selection pulses. It should also be noted that edges of the color selection pulses denoted by $DO_1$, $DO_2$ and $DO_3$ in the Figure are shown as steep edges but are actually half a sine function which has, for example, a period of a ½ $\mu$sec while a single color-selection pulse lasts, for example, 10 $\mu$sec.

The time diagram $S_1$ shows the closing times of the identically denoted switch. If this switch closes, $DO_1$ will be discharged and $DO_2$ will be charged. Closing of the switch $S_1$ during $T_{n-1}$ initiates the start of the trailing edge of the $\tau_B$ pulse at $DO_1$ and of the leading edge of the $\tau_G$ pulse at $DO_2$. Closing of $S_1$ during $T_n$ initiates the start of the trailing edge of the $\tau_G$ pulse at $DO_1$ and of the leading edge of the $\tau_R$ pulse at $DO_2$. Corresponding functions are performed by the switches $S_2$ and $S_3$. The instant when the switches $S_1$, $S_2$ and $S_3$ open again is not critical but should have taken place before the associated "left" driver output $DO_1$, $DO_2$ and $DO_3$, respectively, is charged again.

FIG. 4B also shows the time diagrams with the closing times of the switches $S_1$, $SL_2$, $SL_3$, $SH_1$, $SH_2$ and $SH_3$. $SL_1$ and $SH_1$ preferably close simultaneously after finishing the energy transfer from $DO_1$ to $DO_2$ introduced by closing of $S_1$. $SL_1$ should be open at the latest before the energy transfer from $DO_3$ to $DO_1$ introduced by closing of $S_3$ begins and $SH_1$ should be open at the latest before the energy transfer from $DO_2$ to $DO_3$ introduced by closing of $S_2$ begins. In other words: $SL_1$ may only be closed during the absence of a pulse at $DO_1$ and $SH_1$ may only be closed during the presence of a pulse at $DO_2$. Corresponding rules apply to the other switches $SL_2$, $SL_3$, $SH_2$ and $SH_3$. The Applicant's European Patent Application 94202569.3 (PHN 14.980) states that the period of the different color selection time fractions $\tau_R$, $\tau_G$ and $\tau_B$ may be mutually different. The present invention may then also be used, be it with some adaptations of the closing times of the switches.

A numerical example will elucidate the operation of the embodiment of FIG. 4. Let it be assumed that a 100 Hz display device is used with 625 lines per frame and 625 color-selection electrodes of 60 pF each to which 625 pulses of 200 volts are applied per frame. The total dissipation upon driving with non-resonant pulse drivers is then 60 pF*(200 volts)$^2$ *(the number of pulses per selection electrode=625) *(the number of selection electrodes=625)*(the number of frames per second=100)=93.75 Watt. When using resonant pulse drivers according to the invention, which may have an energy efficiency of 90%, the dissipation is only 9.375 Watt. Since, as shown in FIG. 4B, the $\tau_B$ pulse on each electrode directly follows the $\tau_R$ pulse, there are thus only 4 pulse edges instead of 6 required for 3 pulses. This results in a further reduction of the dissipation by 33.3% to 6.25 Watt. If the number of resonant pulse drivers is doubled (to 6) and the number of selection electrodes connected to a driver output electrode is halved, accordingly, then the number of selection pulses per selection electrode and hence the dissipation is also halved (to 3.125 Watt). Here, an important aspect of the invention becomes manifest: as the used selection pulse drivers dissipate less energy, the selection electrodes may be subdivided into a smaller number of larger groups while the total dissipation remains equal, so that the number of required selection pulse drivers and the associated driver output electrodes decreases. Hence, by using resonant pulse drivers with a small dissipation, the number of such pulse drivers can be reduced considerably.

If it is desirable that a smaller number of resonant selection pulse drivers than the number of selection electrodes is sufficient in a single selection structure, i.e., in which no preselection is used, then this may be realised by incorporating a switch in series with each selection electrode. This switch is then normally open, and is closed when a selection pulse is desired at the relevant selection electrode.

The latter solution cannot be used for driving the preselection electrodes 9 of the display device described with reference to FIGS. 1 and 2, because these selection electrodes should not only have selection pulses, but also a bias voltage varying with the ordinal number of the selection electrodes. A solution is shown in FIG. 5 in which elements corresponding to those in FIG. 4 have the same reference numerals.

Figure 5:
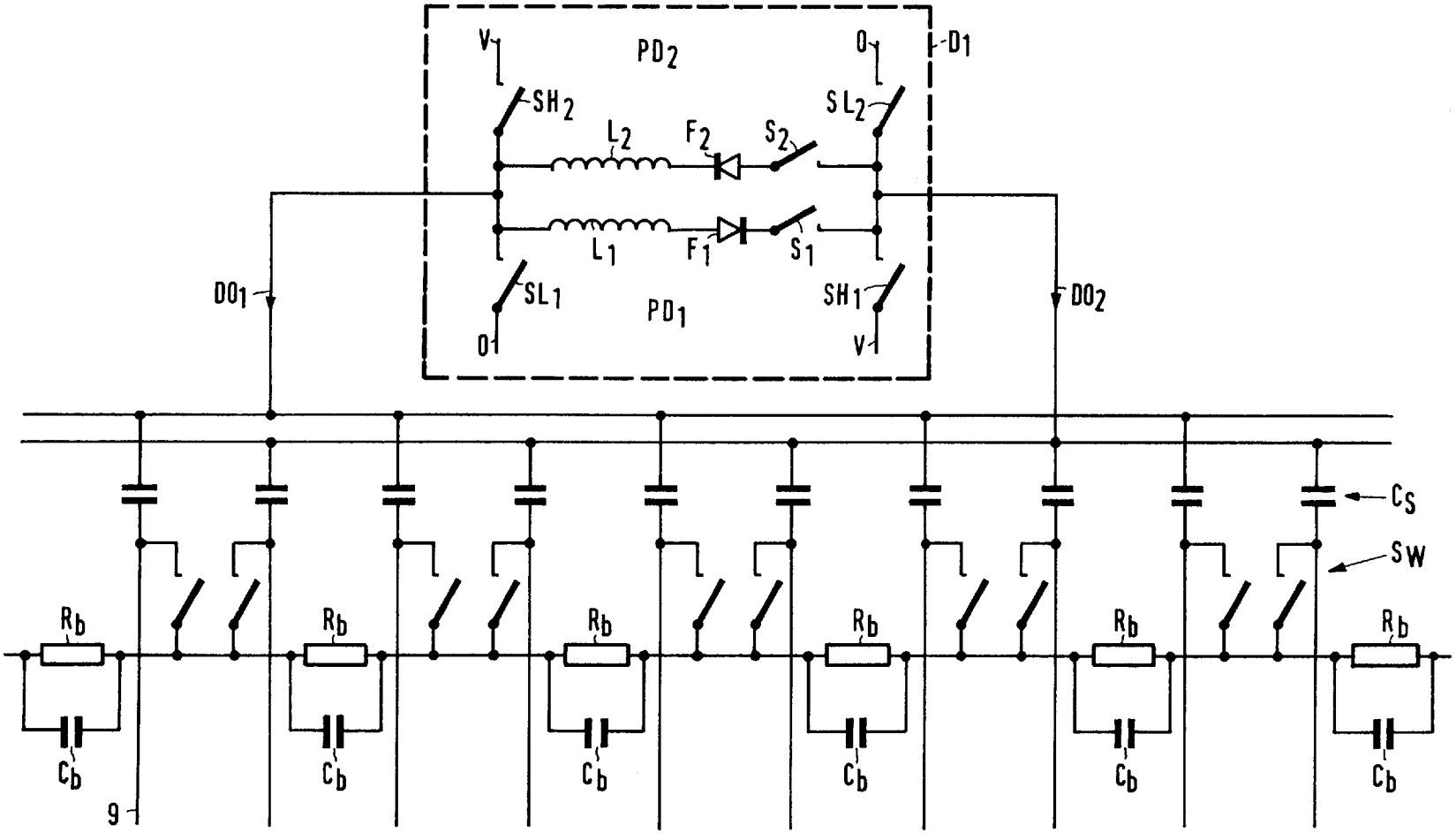
FIG. 5 shows a second embodiment of a picture display device according to the invention.

The circuit of FIG. 5 comprises two resonant selection pulse drivers $PD_1$ and $PD_2$ whose outputs $DO_1$ and $DO_2$ are connected to two groups of preselection electrodes 9. The group connected to $DO_1$ comprises, for example, the odd electrodes, and the group connected to $DO_2$ comprises the even electrodes. The electrodes 9 are each connected to the respective driver output electrode via a coupling capacitor $C_s$. For generating the required bias voltages, a bleeder network is incorporated which consists of the series arrangement of a plurality of bleeder resistors $R_B$,each being decoupled by a capacitor $C_B$. Each selection electrode 9 is connected to a tap of the bleeder network via a fred-fet switch $S_W$.

In operation, the two resonant selection pulse drivers alternately supply selection pulses having sine-shaped edges from the driver outputs $DO_1$ and $DO_2$. Normally, the switches $S_W$ are closed so that the selection pulses cannot reach the selection electrodes and these electrodes convey the voltage fixed by the bleeder network. Two adjacent selection electrodes are each time connected to the same tap of the bleeder network so that the pulsatory short-circuit currents through the fet switches compensate each other pair-wise and do not flow through the bleeder resistors. This reduces the required bleeder decoupling by means of the capacitors $C_B$. As soon as it is a selection electrode's turn to receive a selection pulse, the relevant fet switch is opened. The capacitance of the coupling capacitors $C_s$ should be sufficiently large with respect to the capacitance of the selection electrodes, because otherwise, a too large part of the generated selection pulse will be present across the coupling capacitor.

The two inductances $L_1$ and $L_2$ may be replaced by a single inductance. Of course, it is also possible to use more than two resonant selection pulse drivers with as many groups of selection electrodes in the circuit of FIG. 5.

The invention is not limited to picture display devices with a display unit of the secondary emission type as described with reference to FIGS. 1 and 2. As the case may be, the invention may also be used for other display panels such as EL panels, plasma panels or LCD panels.

We claim:

1. A picture display device comprising a picture display unit with pixels arranged in rows and selection electrodes for selecting the rows of pixels by selection pulses, one or more resonant selection pulse drivers for supplying the selection pulses to the selection electrodes via driver output electrodes, each driver output electrode constituting a capacitive load comprising a selection electrode capacitance for the relevant resonant selection pulse driver, said resonant selection pulse driver comprising switching means and an inductance which constitutes a resonant circuit with said capacitive load when the switching means is closed, wherein the resonant selection pulse driver is connected between two driver output electrodes, in which the inductance constitutes a resonant circuit together with the capacitive loads of the two driver output electrodes when the switching means is closed, and wherein the selection electrodes are subdivided into groups of selection electrodes, and in that each group of selection electrodes is connected to a driver output electrode, characterized in that said picture display device includes a multiple selection structure with preselection electrodes for selecting groups of rows of pixels, said preselection electrodes preceding said selection electrodes.

2. A picture display device comprising a picture display unit with pixels arranged in rows and selection electrodes for selecting the rows of pixels by selection pulses. one or more resonant selection pulse drivers for supplying the selection pulses to the selection electrodes via driver output electrodes, each driver output electrode constituting a capacitive load comprising a selection electrode capacitance for the relevant resonant selection pulse driver, said resonant selection pulse driver comprising switching means and an inductance which constitutes a resonant circuit with said capacitive load when the switching means is closed, wherein the resonant selection pulse driver is connected between two driver output electrodes, in which the inductance constitutes a resonant circuit together with the capacitive loads of the two driver output electrodes when the switching means is closed, and wherein the selection electrodes are subdivided into groups of selection electrodes, and in that each group of selection electrodes is connected to a driver output electrode, characterized in that said picture display device comprises separate switching means per selection electrode for switching off unwanted selection electrodes and switching on desired selection electrodes, respectively.

3. A picture display devices as claimed in claim 2, characterized in that the selection electrodes are connected to the driver output electrodes via coupling capacitors, and in that in the conducting state, the separate switching means subjects the relevant selection electrode to a bias voltage, said separate switching means being opened for admitting a selection pulse to the relevant selection electrode.

4. A picture display device comprising a picture display unit with pixels arranged in rows and selection electrodes for selecting the rows of pixels by selection pulses one or more resonant selection pulse drivers for supplying the selection pulses to the selection electrodes via driver output electrodes, each driver output electrode constituting a capacitive load comprising a selection electrode capacitance for the relevant resonant selection pulse driver, said resonant selection pulse driver comprising switching means and an inductance which constitutes a resonant circuit with said capacitive load when the switching means is closed, wherein the resonant selection pulse driver is connected between two driver output electrodes, in which the inductance constitutes a resonant circuit together with the capacitive loads of the two driver output electrodes when the switching means is closed, wherein said picture display device includes a plurality of driver output electrodes which sequentially receive selection pulses, and, each time, a resonant selection pulse driver is connected between two driver output electrodes which are juxtaposed in the sequence, and a resonant selection pulse driver is connected between the last driver output electrode and the first driver output electrode of the sequence, and wherein the selection electrodes are subdivided into groups of selection electrodes, and each group of selection electrodes is connected to a driver output electrode, characterized in that said picture display device includes a multiple selection structure with preselection electrodes for selecting groups of rows of pixels, said preselection electrodes preceding said selection electrodes.

5. A picture display device comprising a picture display unit with pixels arranged in rows and selection electrodes for selecting the rows of pixels by selection pulses, one or more resonant selection pulse drivers for supplying the selection pulses to the selection electrodes via driver output electrodes, each driver output electrode constituting a capacitive load comprising a selection electrode capacitance for the relevant resonant selection pulse driver, said resonant selection pulse driver comprising switching means and an inductance which constitutes a resonant circuit with said capacitive load when the switching means is closed, wherein the resonant selection pulse driver is connected between two driver output electrodes, in which the inductance constitutes a resonant circuit together with the capacitive loads of the two driver output electrodes when the switching means is closed, wherein said picture display device includes a plurality of driver output electrodes which sequentially receive selection pulses, and, each time, a resonant selection pulse driver is connected between two driver output electrodes which are juxtaposed in the sequence, and a resonant selection pulse driver is connected between the last driver output electrode and the first driver output electrode of the sequence, and wherein the selection electrodes are subdivided into groups of selection electrodes, and each group of selection electrodes is connected to a driver output electrode, characterized in that said picture display device comprises separate switching means per selection electrode for switching off unwanted selection electrodes and switching on desired selection electrodes, respectively.

6. A picture display devices as claimed in claim 5, characterized in that the selection electrodes are connected to the driver output electrodes via coupling capacitors, and in that in the conducting state, the separate switching means subjects the relevant selection electrode to a bias voltage, said separate switching means being opened for admitting a selection pulse to the relevant selection electrode.

* * * * *